US011118456B2

(12) United States Patent
Warren et al.

(10) Patent No.: US 11,118,456 B2
(45) Date of Patent: Sep. 14, 2021

(54) METHODS AND RELATED SYSTEMS FOR GENERATING PRESSURIZED AIR WITHIN AN OPPOSED PISTON ENGINE

(71) Applicants: James C. Warren, Alexandria, VA (US); Scott Jorda, Westminster, MD (US); William V. Meyers, Jr., Sherwood Forest, MD (US)

(72) Inventors: James C. Warren, Alexandria, VA (US); Scott Jorda, Westminster, MD (US); William V. Meyers, Jr., Sherwood Forest, MD (US)

(73) Assignee: ENGINUITY POWER SYSTEMS, INC, Alexandria, VA (US)

( * ) Notice: Subject to any disclaimer, the term of this patent is extended or adjusted under 35 U.S.C. 154(b) by 0 days.

(21) Appl. No.: 16/421,417

(22) Filed: May 23, 2019

(65) Prior Publication Data

US 2019/0360337 A1 Nov. 28, 2019

Related U.S. Application Data

(60) Provisional application No. 62/675,741, filed on May 23, 2018.

(51) Int. Cl.

| | |
|---|---|
| ***F01B 7/14*** | (2006.01) |
| ***F01B 9/02*** | (2006.01) |
| *F02B 75/28* | (2006.01) |
| *F02B 75/24* | (2006.01) |

(52) U.S. Cl.

CPC ..... *F01B 7/14* (2013.01); *F01B 9/02* (2013.01); *F02B 75/24* (2013.01); *F02B 75/28* (2013.01)

(58) Field of Classification Search

CPC .... F01B 7/14; F01B 9/02; F02B 75/28; F02B 75/24

See application file for complete search history.

(56) References Cited

U.S. PATENT DOCUMENTS

| | | | | | |
|---|---|---|---|---|---|
| 2,768,616 | A * | 10/1956 | Venediger | F01B 7/14 | 123/51 BD |
| 3,182,643 | A * | 5/1965 | Tenney | F01B 7/14 | 123/51 R |
| 4,352,343 | A * | 10/1982 | Batoni | F01B 7/14 | 123/51 BA |
| 4,708,107 | A * | 11/1987 | Stinebaugh | F02B 75/243 | 123/317 |

* cited by examiner

*Primary Examiner* — Syed O Hasan

(74) *Attorney, Agent, or Firm* — Capitol Patent & Trademark Law Firm, PLLC

(57) ABSTRACT

Pressurized air may be generated within a lightweight opposed piston engine without the need to make use of a supercharger. The lightweight engine may be combined with one or more lightweight micro-generators.

19 Claims, 3 Drawing Sheets

METHODS AND RELATED SYSTEMS FOR GENERATING PRESSURIZED AIR WITHIN AN OPPOSED PISTON ENGINE

RELATED APPLICATIONS

This application claims priority to U.S. Provisional Application No. 62/675,741 filed May 23, 2018 entitled "OPPOSED PISTON ENGINE/MICRO GENERATOR WITH CUSTOM COMBUSTION CHAMBER" (the "'741 application"). This application incorporates by reference the entire disclosure of the 741 application as if it were set forth in full herein. Further, U.S. Pat. No. 4,993,372 (the "372 patent"), U.S. Pat. No. 5,397,922 (the "922 patent") and U.S. Pat. No. 9,512,790 (the "790 patent") and International Application WO 2014/135,198 (the "198 application") are related to the present invention. The present application incorporates by reference herein the entire disclosures of the 372, 922 and 790 patents and 198 application as if such disclosures were set forth in full herein.

SUMMARY

Methods and related systems and devices are described herein that, among other things, generate pressurized air within a combustion chamber of a lightweight, opposed piston engine without using a supercharger.

For example, one exemplary method may comprise: moving a first piston, within the combustion chamber of the lightweight engine, past a first inlet to induct a first, self-supercharged amount of pressurized air into a first crankshaft; moving a second piston, configured on an opposite end of a cylinder from the first piston, within the combustion chamber past a second inlet to induct a second, self-supercharged amount of pressurized air into a second crankshaft substantially at the same time as the first piston is moving by the first inlet, moving the first piston to bottom dead center to allow first pressurized air through a first transfer port, wherein the first pressurized air is at a lower temperature than first exhaust gases; and moving the second piston to bottom dead center to allow second pressurized air through a second transfer port, wherein the second pressurized air is at a lower temperature than second exhaust gases.

The exemplary method may further comprise connecting a first lightweight micro-generator to the first crankshaft and a second lightweight micro-generator to the second crank shaft of the lightweight engine, and selectively operating the first and second lightweight micro-generators individually or at a same time.

Yet further, the method may comprise generating 0 to 8 kilowatts of power from each of the first and second micro-generators, or, alternatively, generating different amounts of power from the first and second micro-generators.

Inventive lightweight engines used in such an exemplary method may weighs between 5 and 30 pounds, or, alternatively, weigh less than 10 pounds. Still further, each of the lightweight micro-generators may weigh between 3 and 10 pounds, or, alternatively may weigh less than 5 pounds.

In addition to inventive methods, the present invention also provides for inventive devices (engines) and systems.

For example, one exemplary lightweight opposed piston engine for generating pressurized air may comprise: a combustion chamber of the opposed piston engine comprising a first piston operable to move within the combustion chamber past a first inlet to induct a first, self-supercharged amount of pressurized air into a first crankshaft, and a second piston, configured on an opposite end of a cylinder from the first piston, operable to move within the combustion chamber past a second inlet to induct a second, self-supercharged amount of pressurized air into a second crankshaft substantially at the same time as the first piston is moving past the first inlet, wherein the first piston is further operable to move to bottom dead center to allow first pressurized air through a first transfer port, wherein the first pressurized air is at a lower temperature than first exhaust gases and the second piston is operable to move to bottom dead center to allow second pressurized air through a second transfer port, wherein the second pressurized air is at a lower temperature than second exhaust gases.

As previously mentioned, such a lightweight engine may weigh between 5 and 30 pounds, or alternatively less than 10 pounds. In embodiments, such a lightweight engine may be made from a metal alloy, one or more additive manufactured plastics or a carbon fiber.

In addition to inventive lightweight engines, the present invention provides for inventive, lightweight systems for generating pressurized air, On such system may comprise: a lightweight opposed piston engine, the engine comprising: a combustion chamber of the opposed piston engine comprising a first piston operable to move within the combustion chamber past a first inlet to induct a first, self-supercharged amount of pressurized air into a first crankshaft, and a second piston, configured on an opposite end of a cylinder from the first piston, operable to move within the combustion chamber past a second inlet to induct a second, self-supercharged amount of pressurized air into a second crankshaft substantially at the same time as the first piston is moving past the first inlet, wherein the first piston is further operable to move to bottom dead center to allow first pressurized air through a first transfer port, wherein the first pressurized air is at a lower temperature than first exhaust gases and the second piston is operable to move to bottom dead center to allow second pressurized air through a second transfer port, wherein the second pressurized air is at a lower temperature than second exhaust gases.

The system may further comprise a first lightweight micro-generator configured to be connected to the first crankshaft.

Such a system may further comprise a second lightweight micro-generator configured to be connected to the second crank shaft of the lightweight engine, In an embodiment, the first and second lightweight micro-generators may operate individually, In an alternative embodiment, the first and second lightweight micro-generators may operate at a same time.

In embodiments, each of the first and second micro-generators may be operable to generate 0 to 8 kilowatts of power. In another embodiment each of the first and second micro-generators may be operable to generate different amounts of power.

As previously mentioned, lightweight engine may weigh between 5 and 30 pounds, or, alternatively, may weigh less than 10 pounds and each of the lightweight micro-generators may weigh between 3 and 10 pounds, or alternatively, may weigh less than 5 pounds.

DETAILED DESCRIPTION, WITH EXAMPLES

Figure 1:
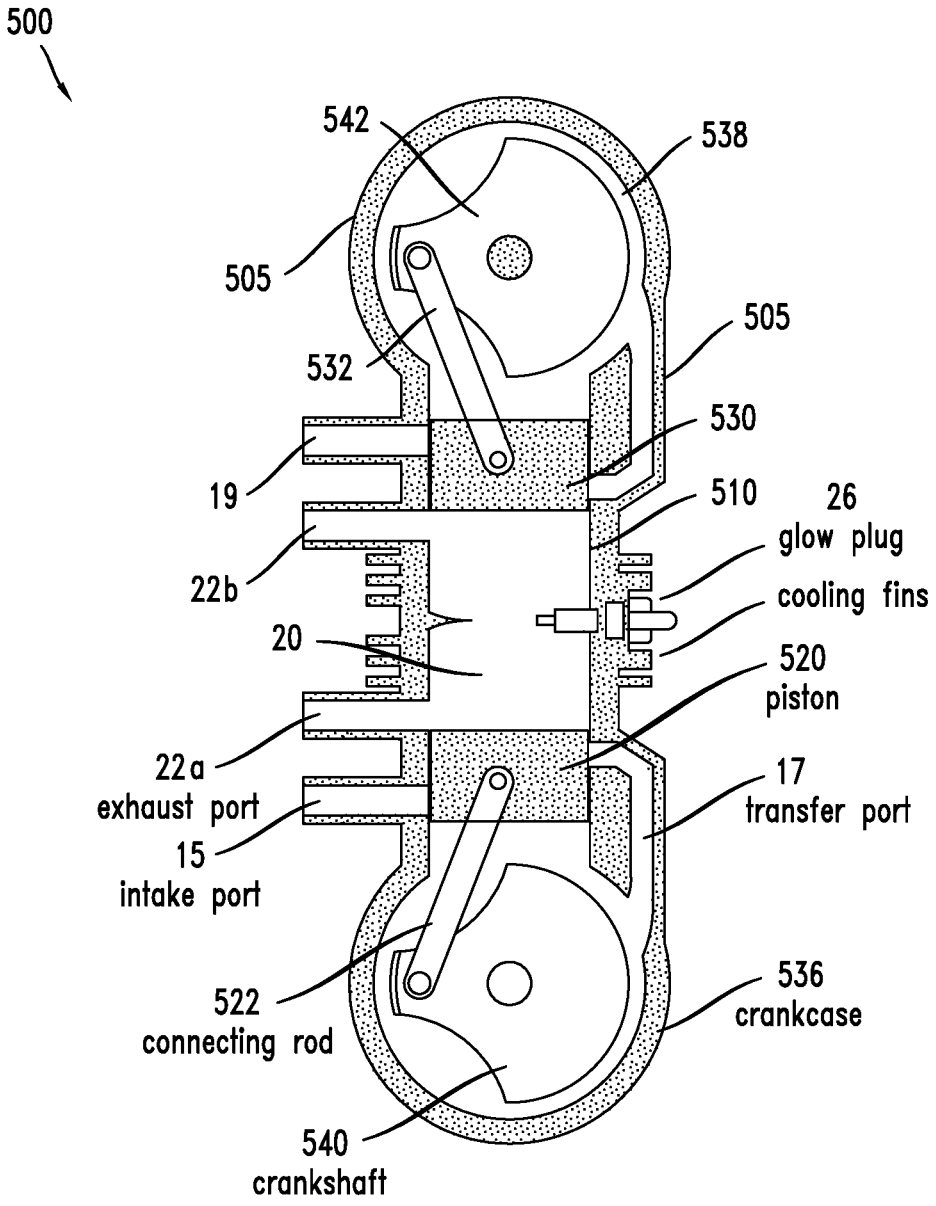
FIG. 1 depicts a lightweight, opposed piston engine according to an embodiment of the invention.

To the extent that any of the figures or text included herein depicts or describes dimensions, power levels, efficiencies or other operating parameters it should be understood that such information is merely exemplary to aid the reader in understanding the embodiments described herein. It should be understood, therefore, that such information is provided to enable one skilled in the art to make and use an exemplary embodiment of the invention without departing from the scope of the invention.

It should be understood that, although specific exemplary embodiments are discussed herein, there is no intent to limit the scope of the present invention to such embodiments. To the contrary, it should be understood that the exemplary embodiments discussed herein are for illustrative purposes, and that modified and alternative embodiments may be implemented without departing from the scope of the present invention. Exemplary embodiments of methods and related systems for generating pressurized air within an opposed piston engine are described herein and are shown by way of example in the drawings. Throughout the following description and drawings, like reference numbers/characters refer to like elements.

It should also be noted that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed and may also include additional steps not included in a description of the process/method.

As used herein, the term "and/or" includes any and all combinations of one or more of the associated listed items. As used herein, the singular forms "a," "an" and "the" are intended to include the plural form, unless the context and/or common sense indicates otherwise.

As used herein the phrase "operable to" means—functions to—.

As used herein, the term "embodiment" and/or "exemplary" refers to an example of the present invention.

Referring to FIG. 1, there is depicted a lightweight, opposed piston engine 500 comprising an engine housing 505. The housing 505 in turn may comprise a first cylinder 510 that includes a first pair of opposed pistons 520 and 530 housed within the first cylinder 510.

In an embodiment, opposed pistons 520 and 530 may be connected via respective connecting rods 522 and 532 to respective crankshafts 540 and 542 mounted in engine housing 505. Pistons 520 and 530 may reciprocate within cylinder 510 to rotate the crankshafts, in a manner known in the art. Each associated crankshaft and/or connecting rod may be configured to aid in providing a predetermined stroke length to its associated piston residing within the cylinder. The opposed first and second pistons 520 and 530 may be of a relatively standard design, and may have predetermined lengths and predetermined diameters. In accordance with an embodiment of the present invention, the customized combustion chamber 20 may couple the two piston assemblies 520/530 together into one opposed piston assembly or engine 500, for example.

In an embodiment, the stroke length of each of pistons 520 and 530 may be about 3 inches. Thus, the total difference between the spacing of the pistons at closest approach to each other (i.e., at "top dead center") may range from 0 inches to 0.25 inches, and more preferably from about 0.05 inches to 0.2 inches, and the maximum spacing of the pistons during the engine cycle (i.e., at bottom dead center) may be about 4-7 inches.

As schematically shown in FIG. 1, and with regard to operation of the piston 520, an inlet 15 may be formed through the housing 505 to provide air into the customized combustion chamber 20 through the combustion chamber inlet 15. As the piston 520 travels to top dead center, it may be operable to create a vacuum as it is moving past the inlet 15 effectively inducting a self-supercharged amount of pressurized air into the corresponding crankcase 536.

Further, at least one fuel injection port (not shown) may fluidly communicate with a fuel injector (not shown) in a known manner for timely providing a fuel spray within the pressurized air provided through the inlet 15, thereby functioning to provide a combustible air-fuel mixture. As the piston 520 compresses the air-fuel mixture at the top dead center position, the glow plug or igniter 26 operably coupled to the combustion chamber 20, may be operable to ignite the air-fuel mixture to produce a downward power stroke of the piston 520 (that is toward the crankcase 536). A first and second exhaust chute 22*a* and 22*b* may be provided for exhaust of the combustion gases through the respective exhaust chute, in this case exhaust chute 22*a*, during the power stroke. As the piston 520 rushes back to bottom dead center during the power stroke, the transfer port 17 may be operable to open up and allow pressurized air to be introduced at a cooler temperature than the exhaust, thereby functioning to facilitate a quicker exhaust of the relatively hotter exhaust gases. Once the piston 520 again begins to travel to top dead center (toward the customized combustion chamber 20), the combustion cycle may begin again.

In substantially the same way, and with regard to operation of the piston 530, a second inlet 19 may be formed through the housing 505 to function to provide air into the customized combustion chamber 20 through the combustion chamber inlet 19. As the piston 530 travels to top dead center it may be operable to create a vacuum as it is moving past the inlet 19 effectively inducting a self-supercharged amount of pressurized air into the corresponding crankcase 538. As described similarly above, at least one fuel injection port (not shown) may fluidly communicate with a fuel injector (not shown) in a known manner for timely providing a fuel spray within the pressurized air provided through the inlet 19, thereby functioning to provide a combustible air-fuel mixture. As the piston 530 compresses the air-fuel mixture at the top dead center position, the glow plug or igniter 26 operably coupled to the combustion chamber 20, may be operable to ignite the air-fuel mixture to produce a downward power stroke of the piston 530 (that is toward the crankcase 538). As with the operation of piston 520, exhaust gases may be shunted through the respective exhaust chute, in this case exhaust chute 22*b*, during the power stroke. As the piston 523 rushes back to bottom dead center during the power stroke, a second corresponding transfer port 21 may be operable to open to allow pressurized air to be introduced at a cooler temperature than the exhaust, thereby functioning to facilitate a quicker exhaust of the relatively hotter exhaust gases. Once the piston 530 again begins to travel to top dead center (toward the customized combustion chamber 20), the combustion cycle may begin again.

Exemplary embodiments of the engine 500 described herein include two lightweight, opposed piston assemblies, and may form a two-cycle engine to provide a source of pressurized air without the need to provide a supercharger, as exemplified in U.S. Pat. No. 4,993,372, for example. In an embodiment, the two pistons 520 and 530 may be timed to reach top dead center at essentially the same time, thereby functioning to optimize the efficiency of a combustion process. In an embodiment, the inventive lightweight engine may weigh less than 10 pounds, or between 5 and 30 pounds depending on the desired engine displacement (weight does not include electronics, e.g., power conditioning inverters, rectifiers, outlets. Inlets, and pulleys, fuel tank), though it should be noted that the weight may fall outside the range just provided depending, again, on the displacement desired. The engine (and its elements) may be made from one or more of the following: a metal alloy (e.g., aluminum 6061 or 6065, titanium), one or more additive manufactured plastics and/or a carbon fiber.

The inventive engine 500 may operate using one or more different types of fuels, such as gasoline, diesel, JP-8, kerosene and alcohol, for example.

Figures 2A, 2B, 2C:
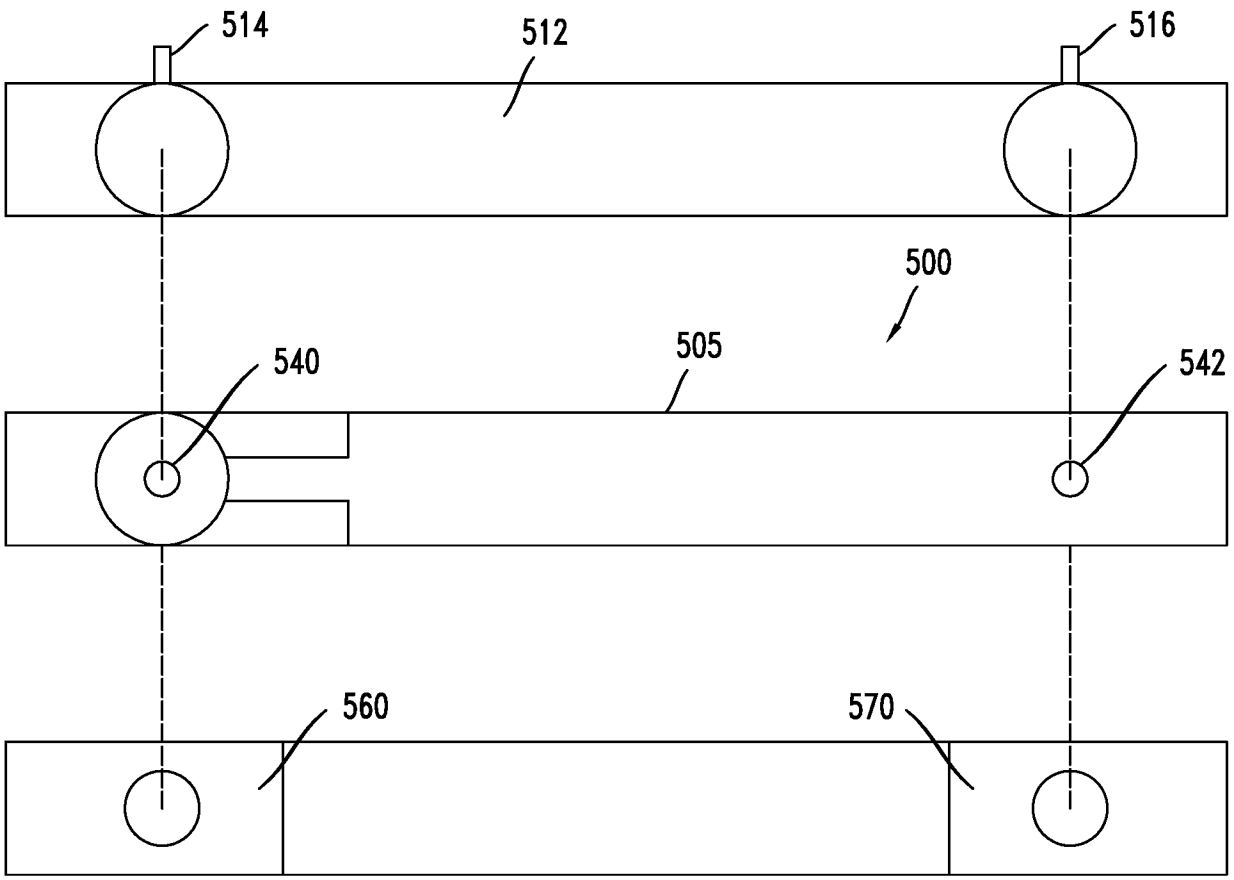
FIGS. 2A to 2C depict sketches of a combined system comprising a micro-generator and a lightweight, opposed piston engine according to an embodiment of the invention.

Referring now to FIGS. 2A to 2C there is depicted a system comprising one or more lightweight micro-generators and a lightweight, opposed piston engine according to an embodiment of the invention. As depicted the system may further comprise crankshafts 540, 542 and may be coupled to an associated gear train, generally designated 512. Gear train 512 may comprise a first power take off 514 and a second power take off 516, for powering of auxiliary equipment connected thereto, for example.

Each crankshaft 540, 542 may also be respectively coupled to a first lightweight micro-generator 560 and a second lightweight micro-generator 570. The micro-generators 560, 570 may comprise rotary generators and may be constructed as disclosed in the '198 application, for example. In an embodiment, the first micro-generator 560 may be designed to provide three kilowatts of power, and, the second micro-generator 570 may be designed to provide five kilowatts of power. The lightweight generators may of course be equipped to produce more or less amounts of power depending on the size of the engine 500, and depending on other desired design criteria. In this exemplary embodiment, the first generator 560 or the second generator 570 may be selectively operated, or, if desired, both generators may be selectively operated to produce from zero up to eight kilowatts of power.

In an embodiment, an individual lightweight micro-generator may weigh less than 5 pounds, or between 3 and 10 pounds and may also be made from one or more of the following: a metal alloy (e.g., aluminum 6061 or 6065, titanium), one or more additive manufactured plastics and/or a carbon fiber.

Figure 3:
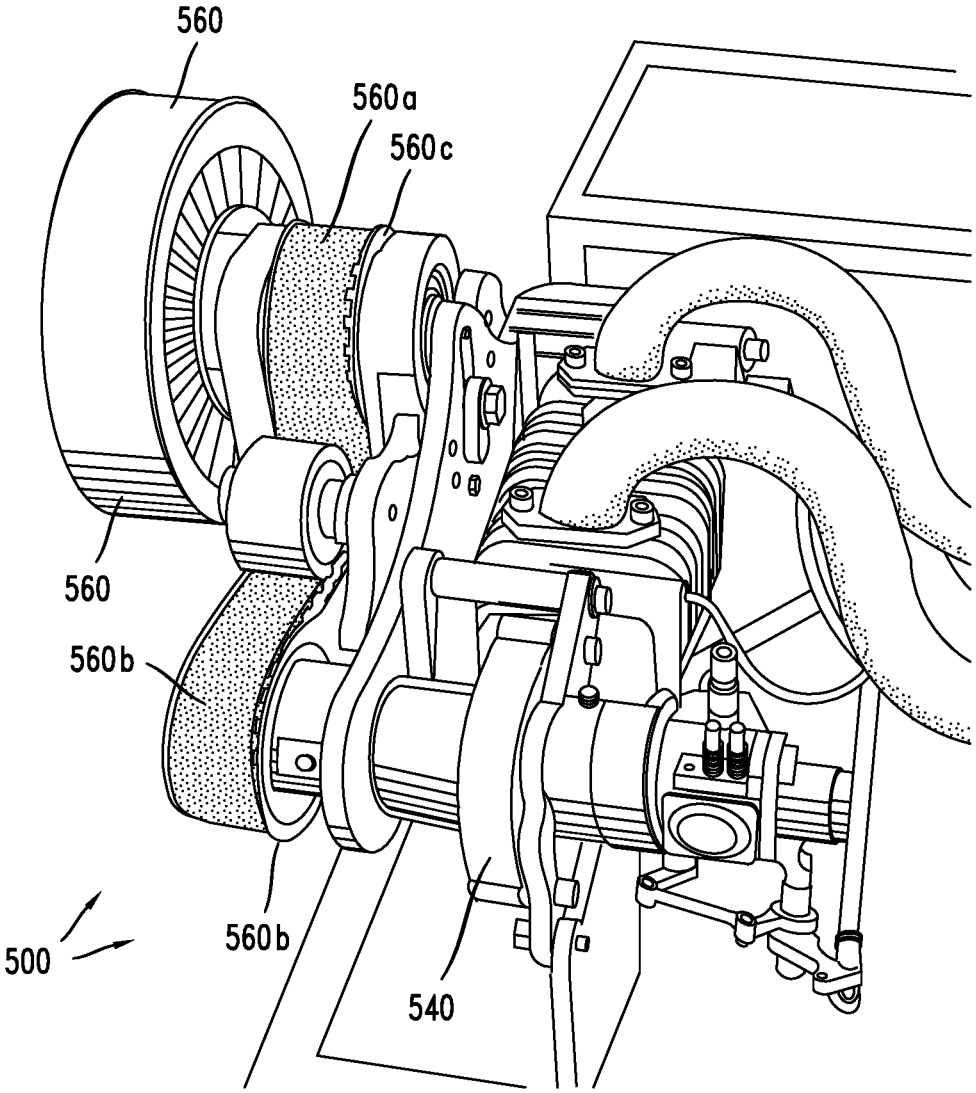
FIG. 3 depicts an image of a combined system comprising one or more micro-generators and a lightweight, opposed piston engine according to an embodiment of the invention.

Referring now to FIG. 3 there is depicted an image of a system comprising a lightweight opposed piston engine 500 and one or more lightweight micro-generators according to an embodiment of the invention. As depicted only one such generator 560 is shown at one end of the engine 500 for the sake of brevity, though it should be understood that at least two generators may be connected to the same engine 500. Each generator may be connected to a respective crankshaft 540,542 via connecting means (e.g., 560*a*, 560*b* and 560*c*) which, for example, in the case of generator 560, may comprise a movable belt 560*a*, rotatable crankshaft endpiece 560*b* and rotatable generator endpiece 560*c*, The endpiece 560*b* may be rotated in consonance with the operation of the crankshaft 540, for example. Further, the rotatable endpiece 560*b* may be operable to move the belt 560*a*, which in turn, moves the rotatable endpiece 560*c* to provide energy for the generator 5560.

It should be understood that the preceding is merely a detailed description of various embodiments of the invention and that numerous changes to the disclosed embodiments can be made in accordance with the disclosure herein without departing from the scope of the invention. The preceding description, therefore, is not meant to limit the scope of the invention. Rather, the scope of the invention is to be determined only by the appended claims and their equivalents.

We claim:

1. A method for generating pressurized air within a combustion chamber of a lightweight, opposed piston engine comprising:

connecting a first lightweight micro-generator to a first crankshaft;

moving a first piston, within the combustion chamber of the lightweight engine composed of a lightweight material, past a first inlet to induct a first, self-supercharged amount of pressurized air into the first crankshaft, wherein the lightweight engine weighs between 5 and 30 pounds;

moving a second piston, configured on an opposite end of a cylinder composed of the lightweight material from the first piston, within the combustion chamber past a second inlet to induct a second, self-supercharged amount of pressurized air into a second crankshaft substantially at the same time as the first piston is moving by the first inlet, moving the first piston to bottom dead center to allow first pressurized air through a first transfer port, wherein the first pressurized air is at a lower temperature than first exhaust gases; and moving the second piston to bottom dead center to allow second pressurized air through a second transfer port, wherein the second pressurized air is at a lower temperature than second exhaust gases.

2. The method as in claim 1 further comprising:

connecting a second lightweight micro-generator to the second crank shaft of the lightweight engine; and selectively operating the first and second lightweight micro-generators individually or at a same time.

3. The method as in claim 2 further comprising generating 0 to 8 kilowatts of power from each of the first and second micro-generators.

4. The method as in claim 2 further comprising generating different amounts of power from the first and second micro-generators.

5. A lightweight opposed piston engine composed of a lightweight material for generating pressurized air comprising:

a combustion chamber of the opposed piston engine composed of the lightweight material comprising a first piston operable to move within the combustion chamber past a first inlet to induct a first, self-supercharged amount of pressurized air into a first crankshaft, and a second piston, configured on an opposite end of a cylinder composed of the lightweight material from the first piston, operable to move within the combustion chamber past a second inlet to induct a second, self-supercharged amount of pressurized air into a second crankshaft substantially at the same time as the first piston is moving past the first inlet, a first lightweight micro-generator configured to be connected to the first crankshaft, a second lightweight micro-generator configured to be connected to the second crank shaft of the lightweight engine, wherein the first and second lightweight micro-generators operate individually or at a same time, wherein the engine weighs between 5 and 30 pounds and the first piston is further operable to move to bottom dead center to allow first pressurized air through a first transfer port, wherein the first pressurized air is at a lower temperature than first exhaust gases and the second piston is operable to move to bottom dead center to allow second pressurized air through a second transfer port, wherein the second pressurized air is at a lower temperature than second exhaust gases.

6. The lightweight engine as in claim 5 wherein the lightweight material comprises a metal alloy, one or more additive manufactured plastics or a carbon fiber.

7. A lightweight system for generating pressurized air comprising:

a lightweight opposed piston engine composed of a lightweight material where the lightweight engine weighs between 5 and 30 pounds, the engine comprising:

a combustion chamber of the opposed piston engine comprising a first piston operable to move within the combustion chamber past a first inlet to induct a first, self-supercharged amount of pressurized air into a first crankshaft, and a second piston, configured on an opposite end of a cylinder composed of the lightweight material from the first piston, operable to move within the combustion chamber past a second inlet to induct a second, self-supercharged amount of pressurized air into a second crankshaft substantially at the same time as the first piston is moving past the first inlet, wherein the first piston is further operable to move to bottom dead center to allow first pressurized air through a first transfer port, wherein the first pressurized air is at a lower temperature than first exhaust gases and the second piston is operable to move to bottom dead center to allow second pressurized air through a second transfer port, wherein the second pressurized air is at a lower temperature than second exhaust gases; and a first lightweight micro-generator configured to be connected to the first crankshaft.

8. The lightweight system as in claim 7 further comprising a second lightweight micro-generator configured to be connected to the second crank shaft of the lightweight engine, wherein the first and second lightweight micro-generators operate individually or at a same time.

9. The lightweight system as in claim 8 wherein the first and second micro-generators are operable to generate 0 to 8 kilowatts of power.

10. The lightweight system as in claim 8 wherein the first and second micro-generators are operable to generate different amounts of power.

11. The lightweight system as in claim 8 wherein each of the lightweight micro-generators weighs between 3 and 10 pounds.

12. The lightweight system as in claim 8 wherein each of the lightweight micro-generators weighs less than 5 pounds.

13. A method for generating pressurized air within a combustion chamber of a lightweight, opposed piston engine comprising:

connecting a first lightweight micro-generator to a first crankshaft;

moving a first piston, within the combustion chamber of the lightweight engine composed of a lightweight material, past a first inlet to induct a first, self-supercharged amount of pressurized air into the first crankshaft, wherein the lightweight engine weighs less than 10 pounds;

moving a second piston, configured on an opposite end of a cylinder composed of the lightweight material from the first piston, within the combustion chamber past a second inlet to induct a second, self-supercharged amount of pressurized air into a second crankshaft substantially at the same time as the first piston is moving by the first inlet, moving the first piston to bottom dead center to allow first pressurized air through a first transfer port, wherein the first pressurized air is at a lower temperature than first exhaust gases; and moving the second piston to bottom dead center to allow second pressurized air through a second transfer port, wherein the second pressurized air is at a lower temperature than second exhaust gases.

14. A method for generating pressurized air within a combustion chamber of a lightweight, opposed piston engine comprising:

connecting a first lightweight micro-generator to a first crankshaft, wherein the lightweight micro-generator weighs between 3 and 10 pounds;

moving a first piston, within the combustion chamber of the lightweight engine composed of a lightweight material, past a first inlet to induct a first, self-supercharged amount of pressurized air into the first crankshaft, wherein the lightweight engine weighs between 5 and 30 pounds;

moving a second piston, configured on an opposite end of a cylinder composed of the lightweight material from the first piston, within the combustion chamber past a second inlet to induct a second, self-supercharged amount of pressurized air into a second crankshaft substantially at the same time as the first piston is moving by the first inlet, moving the first piston to bottom dead center to allow first pressurized air through a first transfer port, wherein the first pressurized air is at a lower temperature than first exhaust gases; and moving the second piston to bottom dead center to allow second pressurized air through a second transfer port, wherein the second pressurized air is at a lower temperature than second exhaust gases.

15. A method for generating pressurized air within a combustion chamber of a lightweight, opposed piston engine comprising:

connecting a first lightweight micro-generator to a first crankshaft, wherein the lightweight micro-generator weighs less than 5 pounds;

moving a first piston, within the combustion chamber of the lightweight engine composed of a lightweight material, past a first inlet to induct a first, self-supercharged amount of pressurized air into the first crankshaft, wherein the lightweight engine weighs between 5 and 30 pounds;

moving a second piston, configured on an opposite end of a cylinder composed of the lightweight material from the first piston, within the combustion chamber past a second inlet to induct a second, self-supercharged amount of pressurized air into a second crankshaft substantially at the same time as the first piston is moving by the first inlet, moving the first piston to bottom dead center to allow first pressurized air through a first transfer port, wherein the first pressurized air is at a lower temperature than first exhaust gases; and moving the second piston to bottom dead center to allow second pressurized air through a second transfer port, wherein the second pressurized air is at a lower temperature than second exhaust gases.

16. A lightweight opposed piston engine composed of a lightweight material for generating pressurized air comprising:

a combustion chamber of the opposed piston engine composed of the lightweight material comprising a first piston operable to move within the combustion chamber past a first inlet to induct a first, self-supercharged amount of pressurized air into a first crankshaft, and a second piston, configured on an opposite end of a cylinder composed of the lightweight material from the first piston, operable to move within the combustion chamber past a second inlet to induct a second, self-supercharged amount of pressurized air into a second crankshaft substantially at the same time as the first piston is moving past the first inlet, a first lightweight micro-generator configured to be connected to the first crankshaft, a second lightweight micro-generator configured to be connected to the second crank shaft of the lightweight engine, wherein the first and second lightweight micro-generators operate individually or at a same time, wherein the engine weighs less than 10 pounds and the first piston is further operable to move to bottom dead center to allow first pressurized air through a first transfer port, wherein the first pressurized air is at a lower temperature than first exhaust gases and the second piston is operable to move to bottom dead center to allow second pressurized air through a second transfer port, wherein the second pressurized air is at a lower temperature than second exhaust gases.

17. A lightweight system for generating pressurized air comprising:

a lightweight opposed piston engine composed of a lightweight material where the lightweight engine weighs less than 10 pounds, the engine comprising:

a combustion chamber of the opposed piston engine comprising a first piston operable to move within the combustion chamber past a first inlet to induct a first, self-supercharged amount of pressurized air into a first crankshaft, and a second piston, configured on an opposite end of a cylinder composed of the lightweight material from the first piston, operable to move within the combustion chamber past a second inlet to induct a second, self-supercharged amount of pressurized air into a second crankshaft substantially at the same time as the first piston is moving past the first inlet, wherein the first piston is further operable to move to bottom dead center to allow first pressurized air through a first transfer port, wherein the first pressurized air is at a lower temperature than first exhaust gases and the second piston is operable to move to bottom dead center to allow second pressurized air through a second transfer port, wherein the second pressurized air is at a lower temperature than second exhaust gases; and a first lightweight micro-generator configured to be connected to the first crankshaft.

18. A lightweight system comprising:

a lightweight, opposed piston engine composed of a lightweight material weighing less than 10 pounds comprising a combustion chamber having a first piston operable to move within the combustion chamber past a first inlet to induct a first, self-supercharged amount of pressurized air into a first crankshaft, and a second piston, configured on an opposite end of a cylinder, composed of the lightweight material, from the first piston, operable to move within the combustion chamber past a second inlet to induct a second, self-supercharged amount of pressurized air into a second crankshaft substantially at the same time as the first piston is moving past the first inlet; and, one or more lightweight micro-generators, one of the one or more micro-generators configured to be connected to the first crankshaft and another of the one or more micro-generators configured to be connected the second crank shaft of the lightweight engine, wherein the first and second lightweight micro-generators operate individually or at a same time.

19. A lightweight system comprising:

an opposed piston engine composed of a lightweight material weighing between 5 and 30 pounds comprising a first piston operable to move within a combustion chamber past a first inlet to induct a first, self-supercharged amount of pressurized air into a first crankshaft, and a second piston, configured on an opposite end of a cylinder composed of the lightweight material from the first piston, operable to move within the combustion chamber past a second inlet to induct a second, self-supercharged amount of pressurized air into a second crankshaft substantially at the same time as the first piston is moving past the first inlet, and one or more lightweight micro-generators.

* * * * *